US007399736B2

(12) United States Patent
Marumo et al.

(10) Patent No.: US 7,399,736 B2
(45) Date of Patent: Jul. 15, 2008

(54) LOW VISCOSITY, HIGH ABRASION RESISTANCE ENGINE OIL COMPOSITION

(75) Inventors: Miyoshi Marumo, Saitama (JP); Yosuharu Yokoyama, Saitama (JP); Hiroyuki Iwasaki, Tokyo (JP)

(73) Assignee: Tonengeneral Sekiyu K.K., Kanagawa (JP)

( * ) Notice: Subject to any disclaimer, the term of this patent is extended or adjusted under 35 U.S.C. 154(b) by 497 days.

(21) Appl. No.: 11/090,632

(22) Filed: Mar. 25, 2005

(65) Prior Publication Data

US 2005/0221998 A1 Oct. 6, 2005

(30) Foreign Application Priority Data

Mar. 31, 2004 (JP) ..... 2004-108573

(51) Int. Cl.
*C10M 137/10* (2006.01)

(52) U.S. Cl. ..... 508/371

(58) Field of Classification Search ..... 208/18; 508/469, 371

See application file for complete search history.

(56) References Cited

U.S. PATENT DOCUMENTS

| | | | | |
|---|---|---|---|---|
| 4,105,571 | A | 8/1978 | Shaub et al. | 252/32.7 E |
| 4,243,538 | A * | 1/1981 | Shubkin | 508/555 |
| 5,866,519 | A * | 2/1999 | Watts et al. | 508/232 |
| 6,408,812 | B1 | 6/2002 | Chamberlin, III et al. | 123/196 R |
| 6,642,189 | B2 * | 11/2003 | Kurihara et al. | 508/364 |
| 6,713,438 | B1 * | 3/2004 | Baillargeon et al. | 508/463 |

FOREIGN PATENT DOCUMENTS

| | | |
|---|---|---|
| EP | 0719851 | 7/1996 |
| EP | 0835923 | 4/1998 |
| EP | 0953629 | 11/1999 |
| JP | 59-027994 | 7/1984 |
| JP | 11-315297 | 11/1999 |
| WO | WO 99/02628 | 1/1999 |

* cited by examiner

*Primary Examiner*—Walter D. Griffin
*Assistant Examiner*—Francis C Campanell
(74) *Attorney, Agent, or Firm*—Estelle C. Bakun; Joseph J. Allocca

(57) ABSTRACT

An engine oil composition that has lower viscosity then the lowest viscosity grade specified by the current standard (SAE (Society of Automotive Engineers) viscosity classification) and achieves excellent abrasion resistance under conditions of high temperature and high shear rate without an increase in the amount of anti-abrasion agent, said engine oil composition characterized by the following facts: the engine oil composition contains 0.02-0.12 mass % of zinc dithiophosphate, measured in the phosphorous amount based on the total weight of the composition, in a base oil compromised of a mineral oil and/or a synthetic oil;

(1) the high-temperature high-shear viscosity at 150° C. and at a shear rate of $1\times10^6$ $s^{-1}$ is less than 2.6 mPa·s;

(2) the engine oil composition satisfies the following equation:

$$\frac{\text{kinematic viscosity at } 100^\circ\text{ C. } (mm^2/s)}{\text{high-temperature high-shear viscosity at } 100^\circ\text{ C. and at a shear rate of } 1\times10^6\ s^{-1}\ (mPa\cdot s)} \leq 1.3.$$

8 Claims, No Drawings

LOW VISCOSITY, HIGH ABRASION RESISTANCE ENGINE OIL COMPOSITION

TECHNICAL FIELD

The present invention pertains to an engine oil composition. More specifically, the present invention pertains to an engine oil composition with low viscosity and excellent abrasion resistance.

BACKGROUND TECHNOLOGY

Engine oil is the general lubricating oil used for internal-combustion engines. In addition to lubricating the piston rings/cylinder liners, crankshaft bearings, dynamic valve mechanism, and other sliding parts in an engine, engine oil has many other functions, such as cooling the engine and cleaning, dispersing, and neutralizing the combustion products entering the crankcase. The aforementioned piston rings/cylinder liners, crankshaft bearings, dynamic valve mechanism, and other sliding parts are the places where friction and abrasion are particularly serious in the engine.

Among the aforementioned sliding parts in the engine, lubrication of the piston ring/cylinder liner and crankshaft bearing mainly belongs to the area of fluid lubrication, while lubrication of the dynamic valve mechanism, that is, the cam/tappet, mainly belongs to the area of elastic fluid lubrication—the area of mixed/boundary lubrication. The friction condition is the most serious. In particular, the shear rate in a dynamic valve system is also as high as $10^7$-$10^8$ $s^{-1}$. An engine oil should be able to withstand such severe conditions.

In particular, demand has developed in recent years for an engine oil with a significant fuel savings effect as an environmental protection measure. Although lowering the viscosity of engine oil is effective in reducing friction in the fluid lubricating area, the lubricating oil film will be destroyed on sliding surfaces in the dynamic valve system in the mixed/boundary lubricating area with a high shear rate. As a result, metal-metal contact is increased, and the increased friction can cause abrasion or seizure. Consequently, it is indispensable to form and maintain a lubricating oil film and guarantee the abrasion resistance when creating a low-viscosity engine oil.

Usually, however, an agent for increasing the viscosity index is added to engine oil in order to guarantee high abrasion resistance at high temperature and good flowability at low temperature to widen the application temperature range. High polymers are widely used as the aforementioned agent for increasing viscosity index. The high-polymer-based viscosity index improver has the typical property of such improvers, that is, a temporary viscosity decrease due to orientation, etc., occurs during operation at high speed/high load or under other high shear conditions, and irreversible viscosity decrease occurs due to molecular weight decrease as a result of chopping of the polymer molecules when the shear conditions become severe. Also, when the viscosity of an engine oil is reduced, the engine oil film itself becomes thinner, which is related to aggravation of the shear conditions. Therefore, for an engine oil in which a viscosity index improver is added, if the viscosity is reduced by simply reducing the viscosity of the base oil, it is not possible to guarantee the oil film under high shear conditions, and abrasion can easily occur.

Consequently, in order to guarantee high abrasion resistance, the amount of zinc dithiophosphate (hereinafter referred to as "ZnDTP") or another organic metal-based phosphorous compound added as anti-abrasion agent is increased. However, since ZnDTP will poison the catalyst used to clean the exhaust gas, its amount should be reduced rather than increased.

Given this situation, a multi-grade lubricating oil with excellent fuel savings effects and heat resistance was proposed by using an alkali earth metal salt of alkyl salicylic acid and an alkali metal salt of alkyl aryl sulfonic acid in combination to create a viscosity index improver (Japanese Kokai Patent Application No. Sho 59[1984]-27994)). However, according to the application examples, the oil type used is adjusted to SAE (Society of Automotive Engineers) No. 10W-30 grade oil. Although the abrasion resistance of the dynamic valve system is improved, since the high-temperature high-shear viscosity at 150° C. (referred to as "HTHS 150° C. viscosity" hereinafter) is required to be 2.9 mPa·s or higher, the good fuel savings effect that is an object of the present invention cannot be realized.

Also, a lubricating oil composition containing 0.04-0.12 mass % of ZnDTP, measured as the phosphorous amount, and 0.8-1.8 mass % of an alkali earth metal salt of alkyl salicylic acid, measured as the amount of sulfate ash, and having an HTHS 150° C. viscosity in the range of 2.4-3.7 mPa·s was proposed as an internal-combustion engine lubricating oil composition having excellent abrasion resistance for the parts of the dynamic valve system (Japanese Kokai Patent Application No. Hei 11[1999]-315297)). However, data for only two HTHS 150° C. viscosities, 2.6 mPa·s and 3.7 mPa·s, are described in the application examples. There is no proof at all concerning whether the abrasion resistance is good enough when the HTHS 150° C. viscosity is reduced to 2.4 mPa·s.

Based on the development situation disclosed by the aforementioned patent references, it is clear that there is an urgent demand for a low-viscosity engine oil with good fuel savings effects, that is, an engine oil having an HTHS 150° C. viscosity lower than 2.6 mPa·s, and excellent abrasion resistance under conditions of high temperature and high shear rate.

PRESENTATION OF THE INVENTION

Consequently, the objective of the present invention is to provide an engine oil composition having a lower viscosity then the lowest viscosity grade specified by the current standard (SAE (Society of Automotive Engineers) viscosity classification) and which has excellent abrasion resistance under conditions of high temperature and high shear rate without any increase in the amount of ZnDTP or other phosphorous-based anti-abrasion agent that will poison the catalyst used to clean the exhaust gas, in order to improve the fuel savings effect.

The present inventors have performed extensive research in order to realize the aforementioned objective. As a result of this research, it was found that even when the viscosity, especially the HTHS 150° C. viscosity of an engine oil composition is further reduced, e.g., to less than 2.6 mPa·s or less than 2.4 mPa·s, if the ratio of the kinematic viscosity at 100° C. (hereafter referred to as "100° C. kinematic viscosity" or "KV100") and the HTHS 100° C. viscosity (KV100/HTHS100) is held below a specific level, good abrasion resistance under conditions of high temperature and high shear rate can be guaranteed for the aforementioned sliding parts in the engine. Also, if the evaporability of the engine oil composition (hereafter referred to as "NOACK evaporability") is controlled because the viscosity of the lubricating oil can be prevented from increasing during the use period, its properties can be stabilized, and this is related to maintaining the fuel savings effect realized by reducing the viscosity. The present invention was achieved based on the aforementioned research.

Thus, even if the HTHS 150° C. viscosity is reduced below 2.6 mPa·s, if the ratio of the 100° C. kinematic viscosity and the HTHS 100° C. viscosity (KV100/HTHS100) of an engine oil composition is 1.3 or lower, good abrasion resistance can be guaranteed without the need to increase the amount of ZnDTP used as the anti-abrasion agent.

The present invention provides an engine oil composition characterized by the following facts: the engine oil composition contains 0.02-0.12 mass % of zinc dithiophosphate, measured as the phosphorous amount based on the total weight of the composition, in a base oil comprised of a mineral oil and/or a synthetic oil;

(1) the high-temperature high-shear viscosity at 150° C. and at a shear rate of $1\times10^6$ $s^{-1}$ is less than 2.6 mPa·s;

(2) the engine oil composition satisfies the following formula:

$$\frac{\text{kinematic viscosity at } 100°\text{C.}(mm^2/s)}{\text{high-temperature high-shear viscosity at } 100°\text{C. and at a shear rate of } 1\times10^6 s^{-1}(mPa\cdot s)} \leq 1.3$$

The "HTHS 150° C. viscosity," "HTHS 100° C. viscosity," and other high-temperature high-shear viscosities of the engine oil composition disclosed in the present invention are measured according to the operations and conditions specified by ASTM D-4683. The shear rate is $1\times10^6$ $s^{-1}$. Preferably the engine oil composition further contains at least one engine oil additive in addition to the zinc dithiophosphate.

The present invention provides an engine oil composition with the aforementioned configuration and an excellent environmentally friendly fuel savings effect. For the engine oil composition of the present invention, the HTHS 150° C. viscosity is lower than 2.6 mPa·s, in particular, lower than 2.4 mPa·s, which is lower than the lowest viscosity grade specified by the current standard (SAE J300) (SAE20; HTHS 150° C. viscosity>2.6 mPa·s). Also, as will be described in the application examples, the engine oil composition has excellent abrasion resistance, as indicated by the depth of SRV abrasion traces. In addition, because its NOACK evaporability is low, the low viscosity can be maintained for a long time. Because the engine oil composition of the present invention can guarantee the aforementioned low viscosity and good abrasion resistance under high shear rate conditions, it is useful not only for ordinary travel conditions but also for internal combustion engines that operate under high-output traveling conditions, for example, travel conditions involving an engine speed of 8000 rpm or higher.

The present invention provides an engine oil composition that has the aforementioned typical viscosity characteristics and excellent fuel savings effects realized by reducing the HTHS 150° C. viscosity below 2.6 mPa·s. Also, by controlling the viscosity of the base oil and, if necessary, the amount of the viscosity index improver added and the amounts of other additives added so that the ratio of the 100° C. kinematic viscosity and the HTHS 100° C. viscosity (KV100/HTHS100) of this engine oil composition is 1.3 or lower, the abrasion resistance can be maintained without increasing the amount of phosphorous introduced by ZnDTP beyond what is present in the conventional technology. Preferred embodiments include the following.

1) The aforementioned engine oil composition in which the aforementioned mixture consisting of a mineral oil type base oil and a synthetic oil type base oil as the aforementioned base oil.

2) The aforementioned engine oil composition wherein the 100° C. kinematic viscosity of the aforementioned base oil is in the range of 2-40 $mm^2/s$.

3) The aforementioned engine oil composition wherein the 100° C. kinematic viscosity of the aforementioned base oil is in the range of 2-20 $mm^2/s$.

4) The aforementioned engine oil composition wherein the 100° C. kinematic viscosity of the aforementioned base oil is in the range of 3-8 $mm^2/s$.

5) The aforementioned engine oil composition wherein the aforementioned HTHS 150° C. viscosity is lower than 2.4 mPa·s.

6) The aforementioned engine oil composition wherein the ratio of the aforementioned 100° C. kinematic viscosity and the HTHS 100° C. viscosity (KV100/HTHS100) lies in the range of 1.20-1.28.

7) The aforementioned engine oil composition wherein the aforementioned HTHS 150° C. viscosity is lower than 2.4 mPa·s and the aforementioned KV100/HTHS100 lies in the range of 1.20-1.28.

8) The aforementioned engine oil composition wherein the aforementioned additional engine oil additive is at least one type of additive selected from among the group comprising viscosity index improvers, ashless dispersants, metal-based cleaning agents, antioxidants, friction adjusting agents, anti-corrosion agents, pour point lowering agents, extreme-pressure agents, and defoaming agents.

9) The aforementioned engine oil composition wherein the content of the aforementioned viscosity index improver is 2 mass % or less based on the total weight of the engine oil composition.

10) The aforementioned engine oil composition used for lubricating an internal combustion engine that can operate at an engine speed at 8000 rpm or higher.

As explained above, the HTHS 150° C. viscosity of the engine oil composition of the present invention is reduced below 2.6 mPa·s. According to the conventional method for reducing viscosity to such a low level, the viscosity of multigrade oil is reduced by simply reducing the viscosity of its base oil. As a result, the abrasion resistance at high temperature is significantly degraded. For the engine oil composition disclosed in the present invention, however, the amount of viscosity index improver that can cause an irreversible viscosity decrease as a result of shearing is controlled, and the oil film is maintained. As a result, good abrasion resistance can be realized without increasing the amount of ZnDTP.

That is, according to the present invention, the viscosity increase contribution achieved by means of the viscosity index improver in the engine oil composition is reduced as much as possible, and the component that can effect good abrasion resistance is increased in relative terms by increasing the viscosity contribution of the base oil. The viscosity increase contribution achieved by means of the viscosity index improver in the engine oil composition is controlled using the KV100/HTHS100 ratio of the engine oil composition as the index. The viscosity of the base oil and the amount of the viscosity index improver should be determined such that KV100/HTHS100 is 1.3 or smaller.

The present inventors have performed extensive research. As a result of this research, it was found that if the KV100/HTHS100 of an engine oil composition is 1.3 or smaller, as will be described in the application examples, good abrasion resistance can be maintained even if the HTHS 150° C. viscosity is reduced below 2.6 mPa·s.

More specifically, for the engine oil composition disclosed in the present invention, in addition to the recipe of the engine oil additives needed for the desired qualities, the viscosity of the base oil and the amount of the viscosity index improver added should be determined such that the HTHS 150° C. viscosity is lower than 2.6 mPa·s, and the KV100/HTHS100 ratio is 1.3 or smaller.

If the engine oil composition is prepared appropriately to have the aforementioned viscosity characteristics, good abrasion resistance can be realized even if the amount of ZnDTP added is restrained to 0.02-0.12 mass %, preferably, 0.04-0.12 mass % measured in terms of the amount of phosphorous in the oil.

Also, the total amount of the engine oil additives, to be described later, should be in the range of 0.5-20 mass %, preferably, in the range of 1.5-10 mass %, based on the total weight of the engine oil composition. The amount of each additive in the total amount of the additives can be determined appropriately according to the desired qualities of the engine oil, as will be described later.

In other words, when it is necessary to increase the amounts of the additives from the standpoint of the performance of the engine oil composition, the conditions of KV100/HTHS100≦1.3 and HTHS 150° C. viscosity<2.6 mPa·s can be satisfied by relatively reducing the 100° C. kinematic viscosity of the base oil. On the other hand, if a relatively small amount of additives is enough, according to the required abrasion resistance, the viscosity of the base oil can be increased within the range of HTHS 150° C. viscosity<2.6 mPa·s in order to realize the fuel savings effect.

Also, one characteristic property required for the engine oil composition disclosed in the present invention is that evaporability should be minimized. Evaporability depends on the light oil component. If a mineral oil is used, when the viscosity of the base oil is to be reduced, it is inevitable that the evaporability will increase. If the evaporability is too high, even if the fuel savings effect can be realized from the viscosity reduction at the beginning of the use period, the viscosity will rise as the light component in the base oil is evaporated during operation of the engine, and the fuel savings effect will be compromised throughout the rest of the use period. Consequently, in order to solve this problem for the engine oil composition disclosed in the present invention, the evaporability is evaluated using a NOACK evaporability test, and it is necessary to hold the evaporability down to 15 mass % or lower. It is preferred to select a proper base oil with low viscosity and a low NOACK evaporability, for example, the ester to be described later, corresponding to the amount the viscosity of the base oil is to be reduced.

In the following, each component of the engine oil composition disclosed in the present invention will be explained in detail. The components of this engine oil composition include the base oil, ZnDTP included in the base oil, and the engine oil additives.

An ordinary base oil for lubricating oil can be used as a component of the engine oil composition. There is no special limitation. Examples include mineral oil type base oil, GTL (gas to liquid) type base oil, synthetic oil type base oil, or their mixture.

Examples of the mineral oil type base oil that can be used include solvent-purified mineral oil or hydrogenated mineral oil prepared using any purification technology, such as solvent purification, hydrogenolysis, hydrogenation purification, solvent dewaxing, contact dewaxing, or clay treatment, to purify a lubricating oil fraction obtained as distilled oil by vacuum distilling the normal-pressure distilled residual oil of paraffin type and/or naphthene type crude oil, mineral oil obtained by performing the aforementioned purification operation to deasphalted oil obtained by performing solvent deasphalting on vacuum-pressure distilled residual oil, mineral oil obtained by isomerizing the wax component, and mixtures of the aforementioned mineral oils. Phenol, furfural, N-methyl-2-pyrrolidone, and other aromatic extraction solvents can be used for the aforementioned solvent purification. Also, liquefied propane, MEK/toluene, etc., can be used as the solvents for solvent dewaxing. On the other hand, shape-selective zeolite, etc., can be used as the dewaxing catalyst in contact dewaxing.

Examples of the GTL type base oil include the lubricating oil fraction separated from the liquid reaction product obtained using natural gas, etc., as a raw material by means of a GTL process, or the lubricating oil fraction obtained by means of hydrogenolysis of generated wax. It is also possible to use the lubricating oil fraction separated from the liquid oil obtained by means of an ATL (asphalt to liquid) process using asphalt or another heavy residual oil component as the raw material.

Based on their viscosity level, the purified base oils prepared as described can be classified into light neutral oil, medium neutral oil, heavy neutral oil, and bright stock, etc.

On the other hand, the synthetic oil type base oil with a viscosity suitable for the engine oil composition disclosed in the present invention can be selected from the following group of compounds: poly α-olefin oligomer (such as poly (1-hexene), poly(1-octene), poly(1-butene), or their mixtures); polybutene; ethylene-alkylene copolymer; alkylbenzene (such as dodecyl-benzene, tetradecylbenzene, di(2-ethylhexyl)benzene, dinonylbenzene, etc.); polyphenyl (such as biphenyl, alkylated polyphenyl, etc.); alkylated diphenyl ether and alkylated diphenyl sulfide, and their derivatives; the esters of dibasic acid (such as phthalic acid, succinic acid, alkyl succinic acid, alkenyl succinic acid, maleic acid, azelaic acid, suberic acid, sebacic acid, fumaric acid, adipic acid, linoleic acid dimer, etc.) and various alcohols (such as butyl alcohol, hexyl alcohol, 2-ethyl hexyl alcohol, isodecyl alcohol, dodecyl alcohol, tridecyl alcohol, ethylene glycol, diethylene glycol monoether, propylene glycol, etc.); the esters of C5-18 monocarboxylic acids and polyols (such as neopentyl glycol, trimethylolpropane, pentaerythritol, dipentaerythritol, tripenterythriol, etc.); polyoxyalkylene glycol, polyoxyalkylene glycol ester, polyoxyalkylene glycol ether, phosphate, etc.

The base oil used for the engine oil composition disclosed in the present invention can be manufactured by using the aforementioned various types of base oils or by properly mixing two or more types of base oils in order to realize the desired viscosity characteristic, NOACK evaporability, and other properties. The 100° C. kinematic viscosity of the base oil prepared in this way is adjusted to within the range of 2-40 $mm^2/s$, preferably, within the range of 2-20 $mm^2/s$, or more preferably, 3-8 $mm^2/s$.

There is no special limitation on the ZnDTP added as a component of the engine oil composition disclosed in the present invention as long as it is a compound used as an anti-abrasion agent for lubricating oil. An example is the compound represented by the following general formula (1).

[Structure 1]

(I)

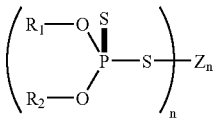

In general formula (I), $R_1$, $R_2$ represent C1-20 hydrocarbon groups, which can be the same or different from each other. Examples of the hydrocarbon groups include C1-20 alkyl groups; C2-20 alkenyl groups; C6-20 cycloalkyl groups, aryl groups, alkylaryl groups, arylalkyl groups, etc. Alkyl groups may include either or both of the primary and secondary alkyl groups. More specifically, compounds having isopropyl groups, isobutyl groups, secondary butyl groups, pentyl group, hexyl group, 4-methyl-2-pentyl group, octyl group, 2-ethylhexyl group, nonyl group, decyl group, dodecyl group, tridecyl group, tetradecyl group, hexadecyl group, octadecyl group, or other alkyl groups can be used.

Consequently, typical examples of zinc dithiophosphate include zinc diisopropyl dithiophosphate, zinc diisobutyl dithiophosphate, zinc secondary butyl dithiophosphate, zinc di(n-pentyl) dithiophosphate, zinc di(n-hexyl) dithiophosphate, zinc di(4-methyl-2-pentyl) dithiophosphate, zinc di(n-octyl) dithiophosphate, zinc di(2-ethylhexyl) dithiophosphate, zinc di(n-nonyl) dithiophosphate, zinc di(n-decyl) dithiophosphate, zinc di(n-dodecyl) dithiophosphate, zinc di(n-tridecyl) dithiophosphate, zinc di(n-tetradecyl) dithiophosphate, zinc di(n-hexadecyl) dithiophosphate, zinc di(n-octadecyl) dithiophosphate, which can be used either alone or as a mixture of several types. The amount of the aforementioned zinc dithiophosphate with respect to the engine oil composition is 0.12 mass % or less, preferably, within the range of 0.02-0.12 mass %, or more preferably, within the range of 0.04-0.12 mass % measured in the phosphorous amount.

In the following, the engine oil additives for the engine oil composition of the present invention will be explained. Examples of viscosity index improvers include non-dispersible polymethacrylate, dispersible polymethacrylate, non-dispersible olefin copolymer (polyisobutylene, ethylene-propylene copolymer), dispersible olefin copolymer, polyalkylstyrene, styrene-butadiene hydrogenated copolymer, styrene-anhydrous maleate copolymer, star-shaped isoprene, etc., which can be used either alone or as a mixture of several types. It can be added within a range such that KV100/HTHS100≦1.3 of the engine oil composition is satisfied. However, it is preferred to limit the amount to about 2 mass %.

With regard to the anti-abrasion agent, other compounds can be added as assistants for the aforementioned ZnDPT. Examples include metal salts other than zinc salt (Pb, Sb, Mo, etc.) of dithiophophoric acid, metal salts (Zn, Pb, Sb, Mo, etc.) of dithiocarbamic acid, metal salts (Pb, etc.) of naphthenic acid, metal salts (Pb, etc.) of fatty acids, boron compounds, phosphoric ester, phosphorous ester, phosphoric ester amine salt, etc. The amount of these compounds is usually within the range of 0.05-2.0 mass %. If the compounds contain phosphorous, the total amount of phosphorous including the phosphorous (P) contained in the aforementioned ZnDTP should be 0.12 mass % or less.

Examples of ashless dispersant include imide succinate, amide succinate, benzylamine, succinic ester, ester amide succinate, and their boron derivatives. It is preferred to use imide succinate and boron-containing imide succinate. An example of imide succinate is polyalkenyl imide succinate. The amount of it is usually within the range of 0.05-8 mass %.

Examples of metal-based cleaning agents include compounds selected from among the sulfonates, phenates, succinates, and carboxylates of calcium, magnesium, barium, etc. Perbasic salts, basic salts, neutral salts, etc., with different basic values can be selected at will. The amount is usually preferred to be within the range of 0.05-5 mass %.

Examples of antioxidants include alkylated phenylamine, phenyl-α-naphthylamine, alkylated phenyl-α-naphthylamine, and other amine-based antioxidants, 2,6-di-t-butylphenol, 4,4'-methylenebis (2,6-di-t-dibutylphenol), isooctyl-3-(3,5-di-t-butyl-4-hydroxyphenyl) propionate, and other phenol-based antioxidants, dilauryl-3,3'-thiodipropionate, and other sulfur-based antioxidants, phosphite and other phosphorous-based antioxidants, molybdenum-based antioxidants, and zinc dithiophosphate, etc. It is particularly preferred to use amine-based antioxidants, phenol-based antioxidants, and their combinations. The amount is usually within the range of 0.05-5 mass %.

Examples of corrosion inhibitors include benzotriazole, benzoimdazole, thiadiazole, and their derivatives. Zinc dialkyl dithiophosphate is also effective against copper-lead bearing corrosion. The amount is preferred to be within the range of 0.01-3 mass %.

Examples of pour point lowering agents include ethylene-vinyl acetate copolymer, the condensation product of paraffin chloride and naphthalene, the condensation product of paraffin chloride and phenol, polymethacrylate, polyalkyl styrene, etc. It is particularly preferred to use polymethacrylate. The amount is usually within the range of 0.01-3 mass %.

Examples of friction adjusting agents include organic molybdenum-based compounds, fatty acids, higher alcohols, fatty acid esters, fat and oil, amine, polyamide, sulfurized ester, phosphoric ester, acidic phosphoric ester, phosphorous ester, phosphoric ester amine salt, etc., which are used within a range such that they will not compromise the abrasion resistance. The amount is usually within the range of 0.05-5 mass %.

Examples of extreme-pressure agents include ashless sulfide compounds, sulfurized fat and oil, phosphoric ester, phosphorous ester, phosphoric ester amine salt, etc. The amount is usually within the range of 0-3 mass %.

Examples of anti-rust agents include fatty acids, alkenyl succinic half ester, fatty acid soap, alkyl sulfonate, polyhydric alcohol fatty acid ester, fatty acid amine, paraffin oxide, alkyl polyoxyethylene ether, etc. The amount is usually within the range of 0-3 mass %.

Examples of defoaming agents include polydimethyl siloxane, polymethacrylate and their fluorine derivatives, perfluoropolyether, etc. The amount is usually within the range of 10-100 mass ppm.

In the following, the present invention will be explained in more detail with reference to application examples and comparative examples. The present invention, however, is not limited to these application examples. The test methods used to evaluate the properties and performance of each sample oil composition used in the application examples are listed below as (1)-(4). Also, the base oil used for each sample oil composition is shown in (5) below, while the zinc dithiophosphate and engine oil additives used are shown in (6) and (7), respectively.

(1) High Temperature High Shear Rate Viscosity (HTHS Viscosity)

HTHS 100° C. viscosity and HTHS 150° C. viscosity were measured at 100° C. and 150° C., respectively, according to the operations and conditions specified in ASTM D-4683.

(2) Kinematic Viscosity (KV)

According to JIS K2283

(3) NOACK Evaporability (NOACK Evaporability Test (ASTM D-5800))

The amount of evaporation was measured after heating at 250° C. for 1 h according to the method detailed in ASTM D-5800. The amount of evaporation was measured using a NOACK automatic evaporation performance measurement device NKC2 produced by ISL.

(4) Abrasion Resistance Evaluating Method

A ball-on-disk frictional abrasion tester produced by SRV was used to carry out an abrasion test. The depth of the abrasion trace was measured by a surface roughness meter. The materials of the ball and disk and the measurement conditions are listed below.

Material of ball and disk: SUJ2

Conditions: Oil temperature 80° C.

Load 50 N

Vibration frequency 50 Hz

Vibration amplitude 1.5 mm

Evaluation time 2 h (5) Base Oil

Mineral oil type base oil

Paraffin-based, solvent-purified mineral A 100° C. kinematic viscosity: 5.2 $mm^2/s$ Paraffin-based, solvent-purified mineral B 100° C. kinematic viscosity: 5.0 $mm^2/s$

| Synthetic oil type base oil | |
|---|---|
| Poly α-olefin A | 100° C. kinematic viscosity: 7.6 $mm^2/s$ |
| Poly α-olefin B | 100° C. kinematic viscosity: 6.4 $mm^2/s$ |
| Poly α-olefin C | 100° C. kinematic viscosity: 6.1 $mm^2/s$ |
| Poly α-olefin D | 100° C. kinematic viscosity: 4.8 $mm^2/s$ |
| Poly α-olefin E | 100° C. kinematic viscosity: 4.1 $mm^2/s$ |

(6) Zinc Dithiophosphate: Mixture of Primary C3/$C_6$-ZnDTP and Secondary $C_8$-ZnDTP (7) Engine Oil Additives (a) Viscosity index improver: Non-dispersible olefin copolymer (b) Other additives An additive package including boron-based polybutenyl imide succinate as an ashless dispersant, perbasic Ca-sulfonate, perbasic Ca-phenate, neutral Ca-sulfonate as metal-based cleaning agents, 4,4'-methylenebis(2,6-di-t-butylphenol), alkyldiphenylamine as antioxidants, thiadiazole as a corrosion inhibitor, and polydimethyl siloxane as a defoaming agent.

APPLICATION EXAMPLE 1

2.4 mass % of the aforementioned additives (additive package and defoaming agent) and 0.6 mass % of zinc dithiophosphate (0.05 mass % in terms of phosphorous amount) were added to a base oil with a 100° C. kinematic viscosity of 6.3 $mm^2/s$ obtained by mixing paraffin-based, solvent-purified mineral A and poly α-olefin A at a ratio of 1:1 (by mass) to obtain sample oil composition A with HTHS 150° C. viscosity: 2.1 mPa·s, KV100/HTHS 100: 1.22, NOACK evaporability: 8 mass %. When the abrasion resistance of sample oil composition A was evaluated by using ball-on-disk frictional abrasion tester produced by SRV, the SRV abrasion trace depth measured was 0.14 μm.

APPLICATION EXAMPLE 2

4.8 mass % of the aforementioned additives (additive package and defoaming agent) and 0.6 mass % of zinc dithiophosphate (0.05 mass % in terms of phosphorous amount) were added to a base oil with a 100° C. kinematic viscosity of 5.8 $mm^2/s$ obtained by mixing paraffin-based, solvent-purified mineral A and poly α-olefin B at a ratio of 1:1 (by mass) to obtain sample oil composition B with HTHS 150° C. viscosity: 2.1 mPa.s and KV100/HTHS 100: 1.22. When the abrasion resistance of sample oil composition B was evaluated as described above, the SRV abrasion trace depth measured was 0.15 μm.

APPLICATION EXAMPLE 3

2.4 mass % of the aforementioned additives (additive package and defoaming agent) and 0.6 mass % of zinc dithiophosphate (0.05 mass % in phosphorous amount) were added to a base oil with a 100° C. kinematic viscosity of 5.6 $mm^2/s$ obtained by mixing paraffin-based, solvent-purified mineral A and poly α-olefin C at a ratio of 1:1 (by mass), followed by adding 1.9 mass % of a viscosity index improver to obtain sample oil composition C with HTHS 150° C. viscosity: 2.1 mPa·s and KV100/HTHS 100: 1.27. When the abrasion resistance of sample oil composition C was evaluated as described above, the measurement result of SRV abrasion trace depth was 0.16 μm.

COMPARATIVE EXAMPLE 1

2.4 mass % of the aforementioned additives (additive package and defoaming agent) and 0.6 mass % of zinc dithiophosphate (0.05 mass % in terms of phosphorous amount) were added to a base oil with 100° C. kinematic viscosity of 5.0 $mm^2/s$ obtained by mixing paraffin-based, solvent-purified mineral A and poly α-olefin D at a ratio of 1:1 (by mass), followed by adding 3.4 mass % of a viscosity index improver to obtain sample oil composition a with HTHS 150° C. viscosity: 2.1 mPa·s and KV100/HTHS 100: 1.35. When the abrasion resistance of sample oil composition a was evaluated as described above, the SRV abrasion trace depth measured was 0.22 μm.

COMPARATIVE EXAMPLE 2

4.8 mass % of the aforementioned additives (additive package and defoaming agent) and 0.6 mass % of zinc dithiophosphate (0.05 mass % in terms of phosphorous amount) were added to a base oil with 100° C. kinematic viscosity of 4.5 $mm^2/s$ obtained by mixing paraffin-based, solvent-purified mineral B and poly αx-olefin E at a ratio of 1:1 (by mass), followed by adding 3.3 mass % of a viscosity index improver to obtain sample oil composition b with HTHS 150° C. viscosity: 2.1 mPa·s and KV100/HTHS 100: 1.35. When the abrasion resistance of sample oil composition b was evaluated as described above, the SRV abrasion trace depth measured was 0.24 μm.

REFERENCE EXAMPLE

A commercially available oil (SAE viscosity grade 5W-30) was purchased, and its abrasion resistance was evaluated using a ball-on-disk frictional abrasion tester produced by SRV. The SRV abrasion trace depth was 0.18 μm. The HTHS 150° C. viscosity was 3.0 mPa·s. It could not realize the fuel savings effect like the low-viscosity engine oil composition disclosed in the present invention.

The composition/properties and performance evaluation of each sample oil composition obtained in the aforementioned application examples and comparative examples are listed in Table 1. When Application Examples 1-3 are compared with Comparative Examples 1-2, it can be seen that the HTHS 150° C. viscosity is lowered below 2.6 mPa·s in each case. However, for sample oil compositions a, b obtained in Comparative Examples 1 and 2, where KV100/HTHS100 exceeded 1.3, the SRV abrasion trace depth was deeper than that of the commercially available oil. The abrasion resistance was degraded as a result of reducing the viscosity. On the other hand, for sample oil compositions A, B, and C obtained in Application Examples 1-3, where KV100/HTS100 was less than 1.3, the SRV abrasion trace depth was very small, which means that an effect favorable to abrasion resistance has been realized. Also, sample oil compositions A, B, and C have smaller abrasion trace depths than the aforementioned commercially available oil, which means that the engine oil composition of the present invention is also very good for practical applications.

More specifically, as can be seen from the comparison between Application Example 1 and Comparative Example 1 and between Application Example 2 and Comparative Example 2, which contain the same amounts of additives except for the viscosity index improver, the viscosity of the base oil was low for both of the comparative examples, and the content of the viscosity indexing improver was correspondingly increased. Therefore, the viscosity decreased under high shear rate conditions. The HTHS 100° C. viscosity became lower than that of the application examples. The KV100/HTHS100 exceeded 1.3, and the abrasion resistance was poor. For Application Example 3, even if a viscosity index improver is added, good abrasion resistance can be obtained as long as KV100/HTHS100 is kept to 1.3 or lower.

The present invention provides a low-viscosity engine oil composition with excellent abrasion resistance. It is an environmentally friendly engine oil composition with significant fuel savings effects. Application of such an engine oil composition to automobile engines is one of the very useful environmental protection measures that have been required for automobiles in recent years. Manufacturing and use of the engine oil composition disclosed in the present invention will contribute greatly to the industrial field.

What is claimed is:

1. An engine oil composition of low viscosity and high abrasion resistance comprising a base oil comprised of a mineral oil, a synthetic oil or mixture thereof and 0.02 to 0.12 mass % of zinc dithiophosphate measured as the amount of phosphorus based on the total weight of the engine oil composition, wherein the engine oil composition:

(1) has a high-temperature high-shear (HTHS) viscosity at 150° C. and at a shear rate of $1\times10^6\ s^{-1}$ of less than 2.6 mPa·s; and (2) satisfies the following formula:

$$\frac{\text{kinematic viscosity at } 100^\circ\text{ C. } (mm^2/s)}{\text{high-temperature high-shear viscosity at } 100^\circ\text{ C. and at a shear rate of } 1\times10^6\ s^{-1}\ (mPa\cdot s)} \leq 1.3.$$

2. The composition of claim 1 further characterized by (3) a NOACK evaporability of 15 mass % or less.

3. The composition of claim 1 or 2 further containing at least one engine oil additive in addition to the zinc dithiophosphate.

4. The composition of claim 1 or 2 wherein the high-temperature high-shear viscosity at 150° C. and at a shear rate of $1\times10^6\ s^{-1}$ is lower than 2.4 mPa·s.

TABLE 1

| | Application Example 1 | Application Example 2 | Application Example 3 | Comparative Example 1 | Comparative Example 2 |
|---|---|---|---|---|---|
| Sample Oil | A | B | C | a | b |
| Viscosity of base oil ($mm^2/s$ @ 100° C.) | 6.3 | 5.8 | 5.6 | 5.0 | 4.5 |
| ZnDTP (mass %) | 0.6 | 0.6 | 0.6 | 0.6 | 0.6 |
| Viscosity index improver* (mass %) | 0 | 0 | 1.9 | 3.4 | 3.3 |
| Other additives** (mass %) | 2.4 | 4.8 | 2.4 | 2.4 | 4.8 |
| P (mass %) | 0.05 | 0.05 | 0.05 | 0.05 | 0.05 |
| NOACK evaporation amount (mass %) | 8 | 9 | 9 | 11 | 13 |
| HTHS 150 (mPa · s) | 2.1 | 2.1 | 2.1 | 2.1 | 2.1 |
| KV100 ($mm^2/s$) | 6.6 | 6.2 | 6.5 | 6.5 | 6.2 |
| HTHS 100 (mPa · s) | 5.4 | 5.1 | 5.1 | 4.9 | 4.6 |
| KV100/HTHS100 | 1.22 | 1.22 | 1.27 | 1.35 | 1.35 |
| SRV abrasion trace depth (μm) | 0.14 | 0.15 | 0.16 | 0.22 | 0.24 |

*Viscosity index improver: Non-dispersible olefin copolymer

Zinc dithiophosphate: Mixture of primary $C_3/C_6$—ZnDTP and secondary $C_8$—ZnDTP

**Other additives

Additive package including boron-based polybutenyl imide succinate as ashless dispersant, perbasic Ca-sulfonate, perbasic Ca-phenate, neutral Ca-sulfonate as metal-based cleaning agents 4,4'-methylene bis(2,6-di-t-butylphenol), alkyl diphenyl amine as antioxidants, thidiazole as corrosion inhibitor, and polydimethyl siloxane as defoaming agent

5. The composition of claim 1 or 2 wherein the ratio of $$\frac{\text{kinematic viscosity at } 100^\circ \text{ C. } (\text{mm}^2/\text{s})}{\text{high-temperature high-shear viscosity at } 100^\circ \text{ C. and at a shear rate of } 1\times10^6\ \text{s}^{-1}\ (\text{mPa}\cdot\text{s})}$$

is in the range of 1.20 to 1.28.

6. The composition of claim 3 wherein (1) the high-temperature high-shear (HTHS) viscosity at 150° C. and at a shear rate of $1\times10^6\ s^{-1}$ is lower than 2.4 mPa·s.

(2) the ratio of $$\frac{\text{kinematic viscosity at } 100^\circ \text{ C. } (\text{mm}^2/\text{s})}{\text{high-temperature high-shear viscosity at } 100^\circ \text{ C. and at a shear rate of } 1\times10^6\ \text{s}^{-1}\ (\text{mPa}\cdot\text{s})}$$

is in the range of 1.20 to 1.28.

7. The composition of claim 3 wherein when at least one additional engine oil additive is a viscosity index improver it is present in an amount of 2 mass % or less based on the total weight of the engine oil composition.

8. The composition of claim 6 wherein when the oil at least one additional engine oil additive is a viscosity index improver it is present in an amount of 2 mass % or less based on the total weight of the engine oil composition.

* * * * *